US005971645A

United States Patent [19]

Fukushima et al.

[11] Patent Number: 5,971,645

[45] Date of Patent: Oct. 26, 1999

[54] HAND-HELD CONTAINER FOR PREDISSOLVING DETERGENT COMPOSITION

[75] Inventors: Kimiko Fukushima, Tondabayashi; Yukio Nanno; Akiko Taneko, both of Kobe, all of Japan

[73] Assignee: The Procter & Gamble Company, Cincinnati, Ohio

[21] Appl. No.: 08/922,554

[22] Filed: Sep. 3, 1997

[51] Int. Cl.[6] ..... B43M 11/06

[52] U.S. Cl. ..... 401/183; 401/205; 401/41

[58] Field of Search ..... 401/268, 274, 401/282, 283, 289, 207, 205, 270, 41, 183

[56] References Cited

U.S. PATENT DOCUMENTS

| | | | |
|---|---|---|---|
| 1,598,968 | 9/1926 | Johnson . | |
| 4,555,019 | 11/1985 | Spendel . | |
| 4,786,199 | 11/1988 | Chen | 401/270 |
| 4,925,327 | 5/1990 | Wirt | 401/205 |
| 5,046,646 | 9/1991 | Stull . | |
| 5,065,913 | 11/1991 | Glaesener . | |
| 5,067,501 | 11/1991 | Auger . | |
| 5,230,442 | 7/1993 | Dean, Jr. . | |
| 5,447,226 | 9/1995 | Laine . | |
| 5,540,341 | 7/1996 | Holley et al. . | |
| 5,547,303 | 8/1996 | Pyrozyk | 401/270 |
| 5,597,255 | 1/1997 | Yager et al. | 401/205 |
| 5,647,481 | 7/1997 | Hundertmark et al. . | |

FOREIGN PATENT DOCUMENTS

| | | |
|---|---|---|
| 0673851 | 9/1995 | European Pat. Off. . |
| 1243684 | 12/1959 | France . |
| 52-67547 | 5/1977 | Japan . |
| 62-28755 | 2/1987 | Japan . |
| 2102398 | 6/1992 | United Kingdom . |
| WO9515710 | 6/1995 | WIPO . |

*Primary Examiner*—David J. Walczak
*Attorney, Agent, or Firm*—Steven R. Chuey; Kim William Zerby; Jacobus C. Rasser

[57] ABSTRACT

A hand-held container for predissolving a predetermined amount of detergent with a predetermined amount of solvent comprises a housing, a resilient side wall, and a dispensing passage. The dispensing passage has a flow restriction portion and an applicator at the distal end. The container is intended for use with fluids with a viscosity of less than about 500 cP. When so used, and aligned to a dispensing orientation, fluid flows out of the dispensing passage at a rate from about 0 ml/min to about 300 ml/min, unless manual pressure is exerted on the resilient side wall.

19 Claims, 13 Drawing Sheets

HAND-HELD CONTAINER FOR PREDISSOLVING DETERGENT COMPOSITION

FIELD

The present invention relates to containers. More specifically, the current invention relates to containers for use with detergent compositions.

BACKGROUND

It is a known consumer habit to predissolve cleaning compositions, especially granular cleaning compositions such as granular laundry detergents. However, even though this habit is known and wide-spread, there are few tools and containers made specifically for the purpose of predissolving cleaning compositions. In addition to being messy, the containers habitually used by some consumers to predissolve cleaning compositions are large and bulky containers, such as mop buckets or wash basins. Some consumers usually use large amounts of water to completely predissolve detergents, believing that detergents must be completely dissolved to achieve greater performance. Accordingly, these large containers become unwieldy and inconvenient to use as well as to store.

It is also known that to adequately clean certain areas of garments, such as heavily soiled areas, spots, and collars, it is a common habit to pre-treat with cleaning products. Pre-treating usually entails washing or scrubbing a particularly soiled area with a commercially available pre-treatment detergent or a bleach product. Containers which are specifically used for pre-treating are available.

Pre-treatment cleaning compositions currently available contain a specific pre-treatment composition inside of a pre-treater, e.g., spray-on pre-treating compositions contained in a spraying applicator. When the pre-treatment composition is completely consumed, the pre-treater itself is discarded.

Current commercially available pre-treaters are used only for pre-treatment; thereafter, a separate detergent product is used to complete the wash cycle. For example, particularly soiled areas are pre-treated before placement of the item in the regular wash cycle of a washing machine, where a separate detergent composition is used for the regular wash cycle. Once the pre-treating process is complete, the pre-treater is stored until the next time it is necessary to pre-treat an item.

SUMMARY

The present invention is directed towards a hand-held container for predissolving a detergent composition including:

a. a housing for containing a predetermined amount of detergent and solvent;

b. the housing having a resilient side wall;

c. the housing having a dispensing passage, the dispensing passage having:
   i. a flow restriction portion therein; and
   ii. a distal end; and d. an applicator located at the distal end of the dispensing passage, wherein when a fluid having a viscosity of less than about 500 cP is formed therein and the container is placed in a dispensing orientation, the dispensing passage and the viscosity are coordinated such that the fluid flowing out of the dispensing passage flows at a rate of from about 0 ml/min to about 300 ml/min, unless manually applied pressure is exerted on the resilient side wall.

BRIEF DESCRIPTION OF THE DRAWINGS

While the specification concludes with claims particularly pointing out and distinctly claiming the invention, it is believed that the present invention will be better understood from the following description of preferred, nonlimiting embodiments taken in conjunction with the accompanying drawings, in which like numerals identify identical elements and wherein:

Figure 1:
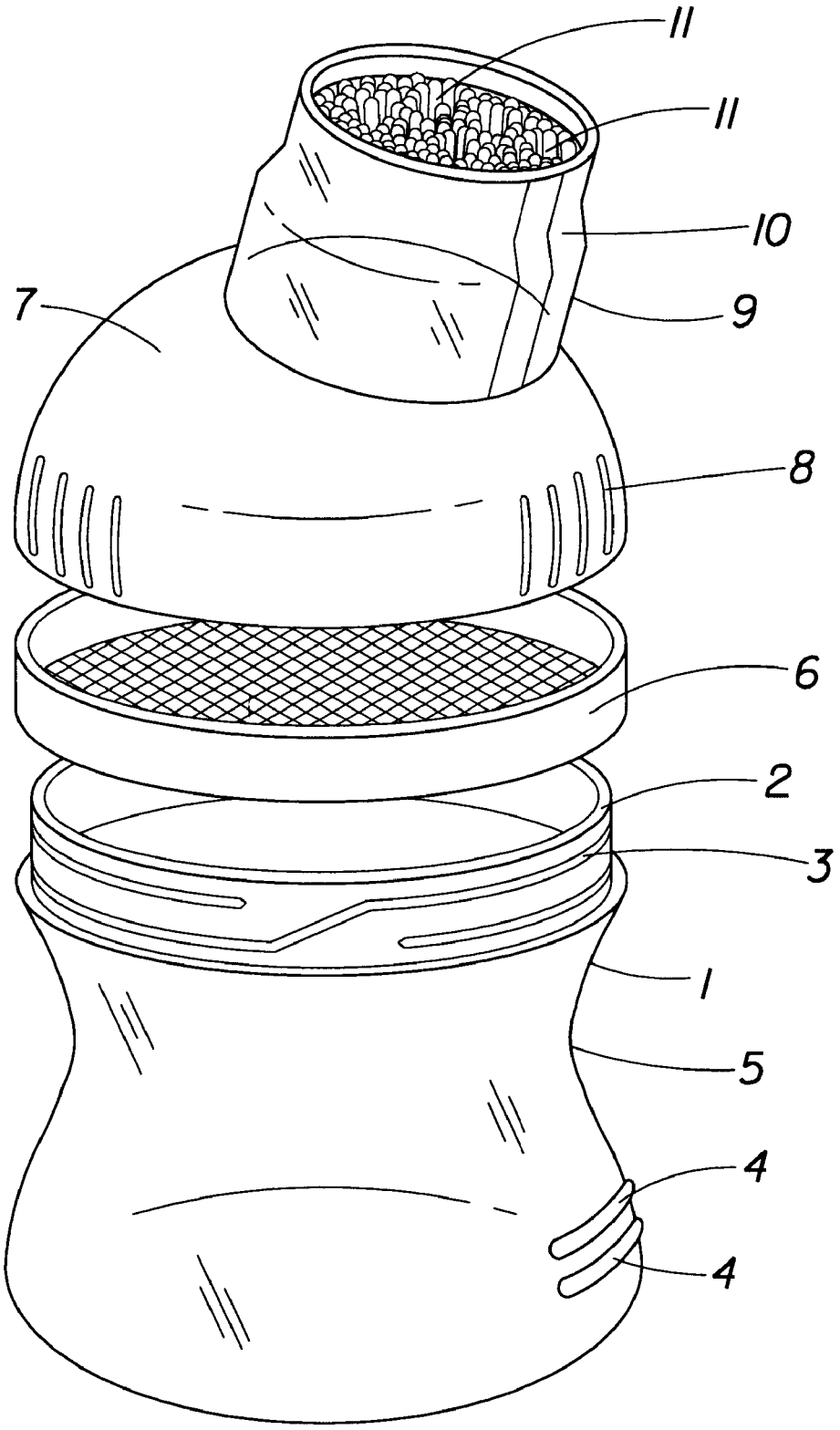
FIG. 1 is an exploded side view of the current invention.

The above referenced drawings are not necessarily to scale.

DETAILED DESCRIPTION

The terms "brush" and "brush-type applicator" as used herein are synonymous.

The terms "clog" and "clogging" as used herein refer to blockages such that dissolved detergent and solvent are prevented from passing through the filter.

The term "detergent composition" as used herein is intended to designate any of the agents conventionally used for removing soil, such as general household detergents or laundry detergents of the synthetic or soap type. The term is also intended to include other cleaning agents.

The terms "dispensing orientation," and "orientation for dispensing," as used herein are defined as a position such that the applicator is touching the surface to be cleaned, or the applicator is substantially parallel to the plane of the surface to be cleaned.

The term "dissolved detergent" as used herein describes detergent dissolved in the solvent, as well as detergent which is undissolved in the solvent, but which does not clog the dispensing passage, and if present, the filter. The cleaning composition and/or detergent used herein need not completely dissolve in the solvent.

The invention and preferred embodiments disclosed herein have many advantages. The present invention is directed to a hand-held container for predissolving a detergent composition. A predetermined amount of detergent composition and solvent are added to the container. In a preferred embodiment, there is an amount of unfilled space in the volume of the container to allow easy and effective mixing of the solvent and the detergent by agitation, e.g., shaking. Although other solvents can be used, a preferred solvent is water.

The invention is more convenient than predissolving with a large container, because of its small size. The invention's small size also makes it easier to store. Because it is designed for predissolving detergent compositions, the invention has features which can make predissolving both convenient and tidy. For example, preferred embodiments can have a wide mouth for easy filling of the container, and a water-tight housing to prevent leakage.

The invention can have multiple uses in addition to being used specifically for predissolving. The invention is also designed so that it can also be used as a pre-treater, if desired. Once predissolved inside the container, the detergent composition can be used to pre-treat spotted, stained, or heavily soiled areas. This makes the pre-treatment process more cost-effective, because the same detergent composition which was predissolved in the container can be used for both pre-treatment and the wash cycle. This saves the user the expense and hassle of purchasing, storing, and using a separate pre-treatment product. In addition, the container is preferably reusable, in that new detergent and solvent can be added therein. This further saves the user the expense and hassle of purchasing replacement pre-treatment products when the pre-treater "runs out." Furthermore, because any detergent can be used therewith, use of the container allows virtually any detergent composition to be utilized as a pre-treatment composition.

The relationship between the viscosity of the fluid formed inside the container and the dispensing passage allows the user to easily control the amount of fluid dispensed from the container. The dispensing passage also allows the user to easily dispense fluid only to where it needs to be applied. The container can also have an applicator, e.g., a brush. A brush is useful to scrub directly on the dirty surface such as stains, spots, and soils. At the same time, the fluid is also dispensed onto the dirty surface.

Once the detergent composition is predissolved and optionally, any pre-treatment has been completed, the predissolved detergent composition can be used to wash. For example, the predissolved detergent composition can be poured into a washing machine tub. Additionally, the container containing the remaining detergent can be placed into the tub of the washing machine so that detergent gradually empties into the tub upon mechanical agitation of the washing machine. This method has the additional advantage of cleaning the container in a virtually effortless manner, without separately cleaning the container. The container can then be refilled and reused as needed.

This container includes, as primary structural components, a housing, to hold a predetermined amount of detergent composition and solvent, a resilient side wall on the housing, and a dispensing passage to dispense the dissolved detergent. The dispensing passage has a flow restriction portion, and a distal end at which is an applicator. The flow restriction portion preferably contains at least one aperture through which dissolved detergent flows. When placed in the container, a predetermined amount of detergent composition and a predetermined amount of solvent form a fluid having a viscosity of less than about 500 centipoise (cP), preferably less than about 250 cP, as measured at about 21° C. Centipoise is the cgs-metric system unit of viscosity and has the dimensions of dyne-seconds per square centimeter or grams per centimeter-second. The dispensing passage is coordinated with this viscosity such that when no manual pressure is exerted on the container, and the container is in a dispensing orientation, the fluid flow rate through the passage is a rate from about 0 ml/min to about 300 ml/min, preferably from about 0 ml/min to less than about 60 ml/min, and more preferably from about 0 ml/min to less than about 20 ml/min. However, it is possible, and intended that when manual pressure is exerted upon the resilient side wall, the flow rate can increase beyond 300 ml/min.

At least one part of the housing forms a resilient side wall, allowing the user to control the amount of detergent dispensed, by applying manual pressure to the resilient side wall. The resilient side wall can be located in any reasonable orientation and at various locations on the housing. For example, the resilient side wall can be located on the sides, bottom, top, dispensing passage, etc. Furthermore, the resilient side wall can take a variety of forms. Nonlimiting examples of the resilient side wall are an actual housing wall, a button attached to the housing, and a window on the housing.

The shape of the housing is extremely variable. Preferably, the shape and material are such as to allow the container to be easily and conveniently handled, thereby providing an ergonomic size and shape which makes it comfortable to hold in the hand. The container preferably seals easily and remains sealed during use so that fluid does not leak out. Preferred housing materials include plastics and polymers, flexible materials such as films and laminated papers, rubber, glass, metal, and combinations thereof. More preferred housing materials include rubber, and plastics such as polyethylene, polypropylene, and polyethylene terephthalate. The container components can be made by any process known in the art suitable for the material(s) chosen. Preferred production processes are blow molding, injection molding, injection blow molding, vacuum forming, and combinations thereof.

If made with films and laminated paper materials, the housing can be made into a sealable or resealable pouch-like form. The container must have sufficient structural rigidity for holding and for controlling the amount of fluid to dispense. More rigid containers with round and oval cross-sections are popular with consumers, and are thus preferred herein; however, other shapes, such as squares or rectangles can be used, for example, to improve storage profiles. It is preferred that the housing be designed so as to easily fit the user's hand, to facilitate handling, holding, shaking, etc. It has been found that housings with cross sections having a plane of symmetry are easily held and ergonomically pleasing. It is preferred that housings having such shapes be used herein. The housing can further contain a mouth for adding detergent composition and solvent, and a cap member. If the mouth of the housing is wide, as seen, for example, in FIG. 1 at 2, then an ergonomic housing size and shape can be achieved by decreasing the cross-sectional area of the housing, as seen at FIG. 1, at 5, away from the mouth.

For convenient use, the mouth should be of sufficient width to easily add the detergent composition and solvent into the housing without spilling. The preferred size and shape of the mouth depends upon many factors such as the type of detergent composition intended for use therein. For example, in containers intended for use with granular detergent compositions, which usually come with some type of measuring device, e.g., a scoop or a cap, it is preferred that the mouth be wide enough to accept the scoop and even a "heaped" scoop. Accordingly preferred mouth sizes for such containers are from about 35 mm to about 120 mm, preferably from about 50 mm to about 105 mm, and more preferably from about 60 mm to about 95 mm in width, as measured at the widest point of the mouth. Preferred mouth sizes for containers for use with liquid and paste detergent compositions can be smaller, and are from about 20 mm to about 95 mm, preferably from about 35 mm to about 80 mm, and more preferably from about 45 mm to about 70 mm in width, as measured at the widest point of the mouth.

It is preferred that the housing and the container be of a reusable type, and the design should therefore facilitate easy reuse, refilling, and cleaning. It is also preferable that the container be shaped and balanced such that it remains standing upright when placed on a flat surface.

The housing has a dispensing passage which allows the user to dispense fluid from the housing. The passage can be formed from a rigid material, a flexible material, or a combination of such materials. The dispensing passage contains a flow restriction portion which controls the flow rate of the fluid passing through the dispensing passage. Preferably, the flow restriction portion allows a controlled amount of fluid to be dispensed. The user can noticeably increase this flow rate by applying manual pressure to a resilient side wall. The flow restriction portion can be any means which will control the flow rate of fluid passing through the dispensing passage. For example, a tube-like structure or a fluid pressure regulator, may be used to control the flow rate.

A preferred embodiment of a flow restriction portion is an aperture, preferably at least one aperture. Preferably, the aperture is the point at which fluid in the container exits the container. The term "aperture" as used herein does not include open-cell structures and porous structures, such as sponges. Such open-cell and porous structures are not intended to be within the scope of the present invention, because they do not allow manual pressure to noticeably increase the flow rate. For example, the flow rate of a container which has a sponge as a flow restriction portion would not noticeably increase upon the application of manual pressure, even though a slight increase may occur.

One or more apertures are preferably located on the distal end of the dispensing passage to allow the user to better control the exiting fluid. While it is preferred that the aperture be in connected relation to the applicator, as described below, this is not necessary to the invention. However, when the aperture and the applicator are so connected, and the container is used for pretreating, detergent exiting the aperture becomes commingled with the applicator, providing for easy and accurately targeted application of the surface to be treated. The number and size(s) of the aperture(s) can and should be tailored to specific physical characteristics of the detergent solution to be dispensed, the solvent used, and consumer preferences. For example, extremely viscous fluids require either larger apertures or a greater number of them for easy and effective dispensing; conversely, a very thin fluid would require either small apertures or relatively few of them, so as to prevent too much solution from being dispensed. In the current invention, preferred aperture sizes range from about 0.0019 $mm^2$ to about 16 $mm^2$, preferably from about 0.2 $mm^2$ to about 5 $mm^2$, and more preferably from about 0.3 $mm^2$ to about 3.2 $mm^2$ in area. Multiple apertures can be arranged together, in a pattern, or even separately. It is preferred that they be arranged together, and in connected relation to the applicator discussed below.

The dispensing passage further contains a distal end. An applicator for contacting the surface to be cleaned is attached to the distal end of the dispensing passage. The applicator allows the user to specifically apply the dissolved detergent to a specific area of interest, for example, a spot on a piece of fabric, or to a collar stain. It is preferred that the applicator be attached to either the cap member and/or the housing. The applicator can be any of many designs, including, but not limited to brushes, roller balls, nozzles, bristles, and combinations thereof, of which brushes, nozzles, and bristles are preferred. It is preferred that at least one applicator be utilized herein, preferably one or two applicators. The applicator can be made of any applicable material, such as plastics, fur, cloth, polymers, rubber, and combinations thereof. Preferred materials for the applicator include polyethylene, polypropylene, plastics, and combinations thereof.

If a brush is utilized herein as a preferred applicator, the bristle strength and length can be tailored to the type of cleaning to be performed. For example, in cleaning fabrics, bristles which are too stiff may harm the fabrics to be cleaned, especially delicate fabrics such as silk. Accordingly, either longer bristles, or softer bristles are preferred. For fabrics, preferred brushes have a bristle strength of less than about 200N/$cm^2$, preferably less than about 150N/$cm^2$. Bristle strength, as noted herein, is measured using the method of JIS S 3016, except that a press head speed of 12.5 mm/min, and a bristle area of about 5.5 $cm^2$ were used; JIS S 3016 is a Japanese Industrial Standard for measuring toothbrush bristle strength. The compression testing machine used herein is a Compression Tester, model YLM-5, made by Toyo Tester, of Osaka, Japan. For other applications or less sensitive surfaces, stiffer bristles may be desirable.

The structural components of the container, such as the housing, dispensing passage, etc., can be made of any material which provides sufficient structural rigidity and solvent resistance. Optional but preferred characteristics of the container material include translucency, transparency, or opaqueness, easy formation to the desired shape(s), resistance to detergent solutions and applicable pH ranges, durability, coloration, and softness to allow the container to be added to the wash cycle without causing undue noise. If the container is to be placed inside the wash cycle, then the material chosen should be both water resistant and temperature resistant to those temperatures at which detergent solutions are used, i.e., typically from about 5° C. to about 60° C. Ideally, the material selected should be resistant to temperatures ranging from below freezing up to above the temperatures at which clothes dryers operate. These optimal ranges may be relevant, for example, where consumers store cleaning supplies outside during the winter, and where the container may be transferred, either intentionally or unintentionally, into a clothes dryer.

Optional Container Components

As an optional component, fasteners are applicable herein for attaching the cap member to the housing, as seen, for example at 3 in FIG. 1. These fasteners preferably form water-tight seals, and are also applicable to, if present, the aperture cover and the covering, where water-tight seals are also desirable. Nonlimiting examples of a preferred fastener are screw-type closures, snap-type closures, hinge-type seals, sliding seals, and combinations thereof. An optional feature which can be included wherever a water-tight seal is desired is an inner plug seal and/or any of many well-known contact-ring seals. These types of gasketless seals are surprisingly water-tight. The inner plug seal, if present, runs around substantially the entire inner circumference of a female member to be sealed, and is received by a reciprocal fitting on the male sealing member. A nonlimiting example of this type of seal is shown as number 20 in FIG. 5. A contact-ring seal runs along the inner surface of a female member and forms a seal with the very tip of the male member, and is preferred.

Figure 2A:
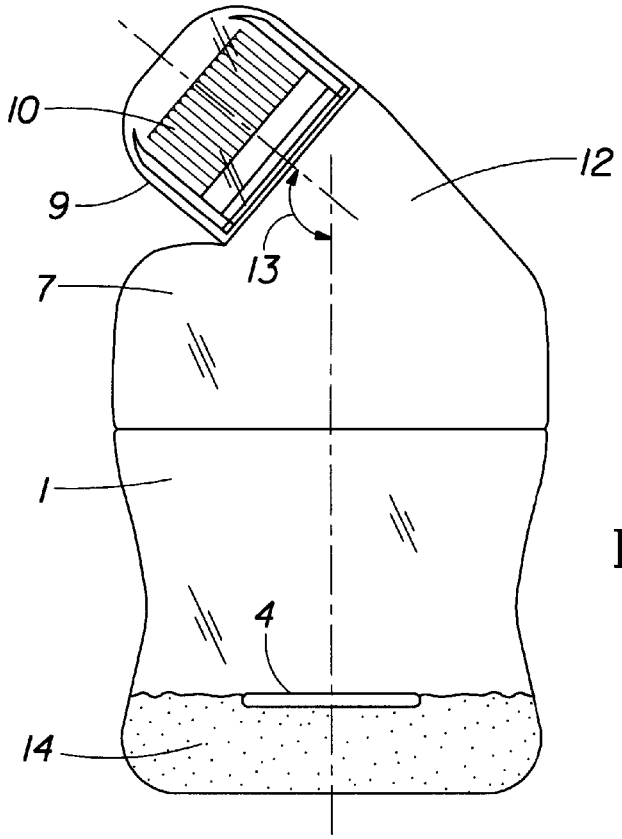
FIG. 2A is a side view of the current invention filled with detergent up to the first level indicator.

As an optional component, the dispensing passage may further contain a neck portion, as seen, for example, at 12, in FIG. 2A. Optionally, the neck portion, if present, may also be located between the housing and the dispensing passage. In a preferred embodiment, the neck portion contains at least one neck angle from about 90 degrees to about 180 degrees. The neck angle is measured from the longitudinal line drawn through the housing. Preferred neck angles for use herein range from about 120 degrees to about 150 degrees. Neck angles of less than 120 degrees become cumbersome to manufacture, while neck angles greater than 150 degrees tend to become inconvenient because they increase clogging of the filter and dispensing passage. A more preferred neck angle is in the range of from about 120 degrees to about 140 degrees. Optionally, more than one neck angle can be useful herein, or even a curved neck portion as seen at 12 in FIG. 5. Ideally, this neck angle is such that, when the housing is filled with a pre-determined amount of detergent and solvent and the entire container is tilted or otherwise aligned into a dispensing orientation, the undissolved detergent does not completely clog the filter, if present. In a preferred embodiment, the neck portion has a neck base distal to the applicator, and a filter is located at the neck base.

A preferred optional component of the invention described herein is a filter or screen located inwardly of the aperture. Inwardly, as used herein refers to a position such that solvent and dissolved detergent passing from the housing through the aperture first passes through the filter. For example, the filter can be placed between the aperture and the housing, as seen in FIG. 1, at 6. The filter can be placed in many possible locations, such as, but not limited to, in and before the neck portion. The filter serves to prevent undissolved detergent from clogging the aperture and the dispensing passage, while allowing dissolved detergent, i.e., non-clogging detergent and solvent, to pass through. If present, the filter should be positioned so as to be interposed between undissolved detergent and the distal end of the dispensing passage.

Filter size (i.e., the diameter of the filter), shape, and orientation is preferably such that substantially all of the detergent passing out of the aperture must first pass though the filter so as to minimize clogging and maximize detergent flow. The filter shape is preferably round, oval, or square. The filter can be slanted or oriented at any angle. Preferably, the plane of the filter is perpendicular to a longitudinal line drawn through the housing, as seen, for example, in FIG. 5. If present, the filter can be formed integrally with other parts of the container, or as a separate piece, and then affixed thereto, as shown, for example, in FIGS. 13–14. If the filter is made separately, then it can be affixed to its desired location in a variety of ways known in the art, such as gluing, heat-sealing, ultrasonic sealing, being clamped into place, or combinations thereof. In preferred embodiments, the filter can be permanently affixed to the container, or made so as to be removable, facilitating easy assembly and cleaning of the container. Removable filters can be either completely removable filters, or partly removable filters. Partly removable filters include those which are essentially fixed to the container at one point, but which can be displaced without completely detaching them from the container, for example, where a filter is hinged and secured into place, but can be unsecured and swung open for easy cleaning.

Filter clogging can be further reduced by placing the filter in areas with a large relative volume. For example, by placing the filter before a narrowing neck portion, rather than inside of a neck portion. In a preferred embodiment, the filter is located at the neck base. The filter can be partially blocked, if desired. Partially blocked filters have a portion which is impenetrable to the solvent and dissolved detergent, and a portion which the solvent and dissolved detergent can pass through.

The filter can be made of many kinds of materials, such as plastics, rubber, thin films, paper, foam, and others. Polyethylene, polypropylene, nylon, acrylonitrile-butadiene-styrene, and stainless steel are preferred materials. As used herein, mesh refers to a filter with regularly-shaped passages, while pore refers to filters having either a regular or an irregular shape. Mesh sizes and pore sizes can be optimized for the size of the detergent composition particles and the characteristics of the dispensing passage. Preferred mesh sizes useful herein are those that average below 300 microns, preferably from about 250 microns to about 20 microns, more preferably from about 225 microns to about 35 microns, and even more preferably from about 200 microns to about 50 microns in width. The filter used, however, need not necessarily be of uniform pore size, and thus filters with pore sizes averaging below about 0.09 $mm^2$, preferably from about 0.0625 $mm^2$ to about 0.0002 $mm^2$, more preferably from about 0.05 $mm^2$ to about 0.0012 $mm^2$, and even more preferably from about 0.04 $mm^2$ to about 0.0025 $mm^2$ are useful herein.

Figure 5:
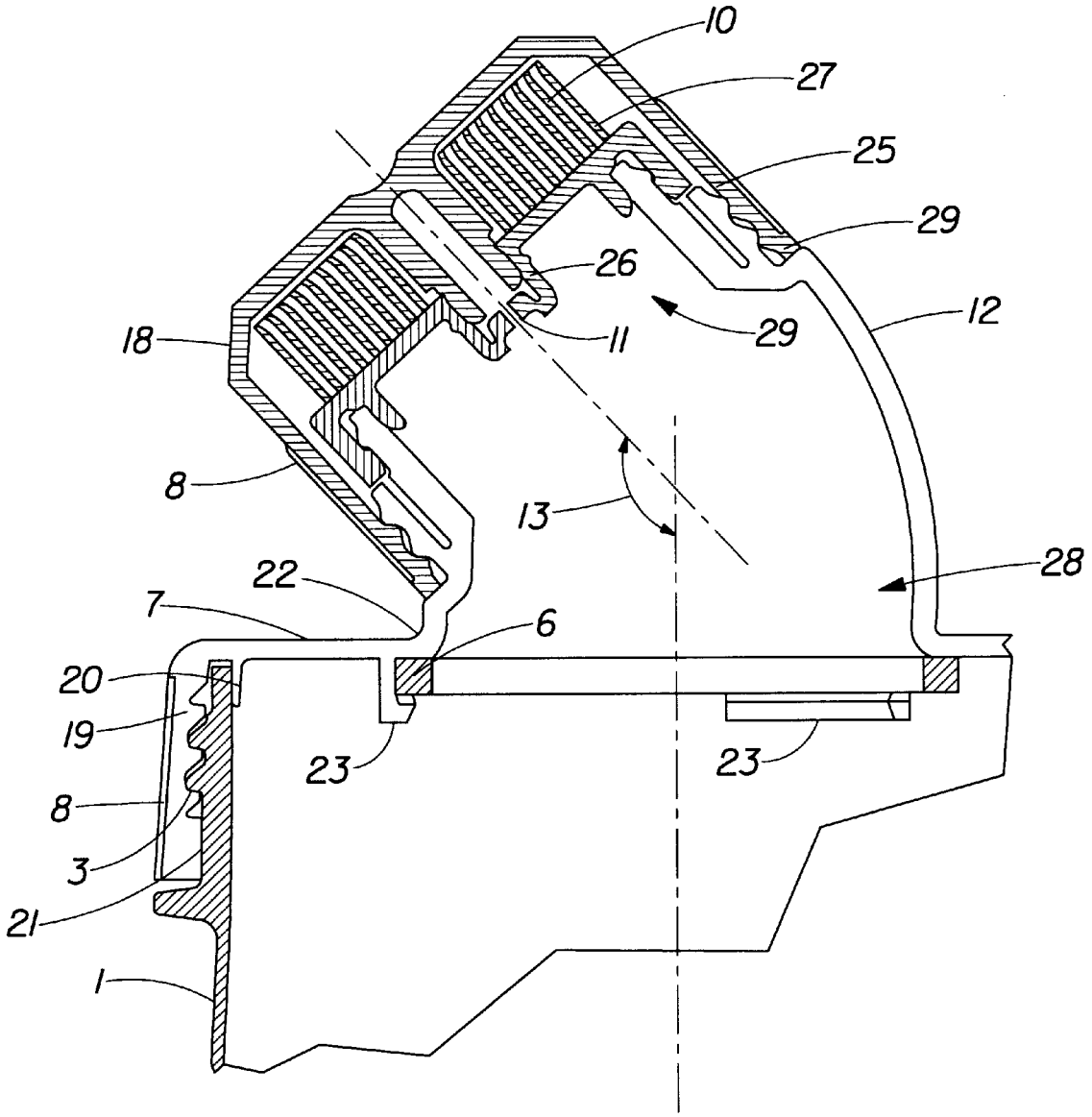
FIG. 5 is a cut-away side view showing details of a cap member.

A preferred method of securing the filter, if present, is by utilizing one or more filter ridges, for example, as seen in FIG. 5, at 23, these being raised ridges placed around the circumference of where the filter is to be placed, and into which a filter snaps into place. The filter ridge(s) can be formed such that the filter is either removable for easy cleaning, or permanently fixed in place. Furthermore, it is important that the filter ridge(s) be formed such that they do not impede the flow of detergent out of the aperture, either by promoting clogging of the filter, or by trapping detergent which would otherwise flow out of the container. Having too many filter ridge(s) or filter ridge(s) which are too large can impede the detergent flow through the filter by forming a ledge upon which detergent can accumulate, eventually completely clogging the filter. In a preferred embodiment, the cap member contains three separate filter ridges equally spaced around the filter.

According to consumer preferences, and to prevent messiness during use, it is often desirable for any aperture and any applicator to have an aperture cover, and a covering, respectively. When the applicator surrounds the aperture, the aperture cover and the covering may be the same. In a preferred embodiment, as seen in FIG. 5, leakage from the aperture is prevented by a water-tight aperture cover which prevents detergent from escaping by forming a water-tight seal. This water-tight seal can be formed between the aperture cover and the aperture itself, the applicator, the cap member, or any other suitable structure. Similar to the aperture cover, in a preferred embodiment, a covering often, but not necessarily forms a water-tight seal with any appropriate container component.

Figure 18:
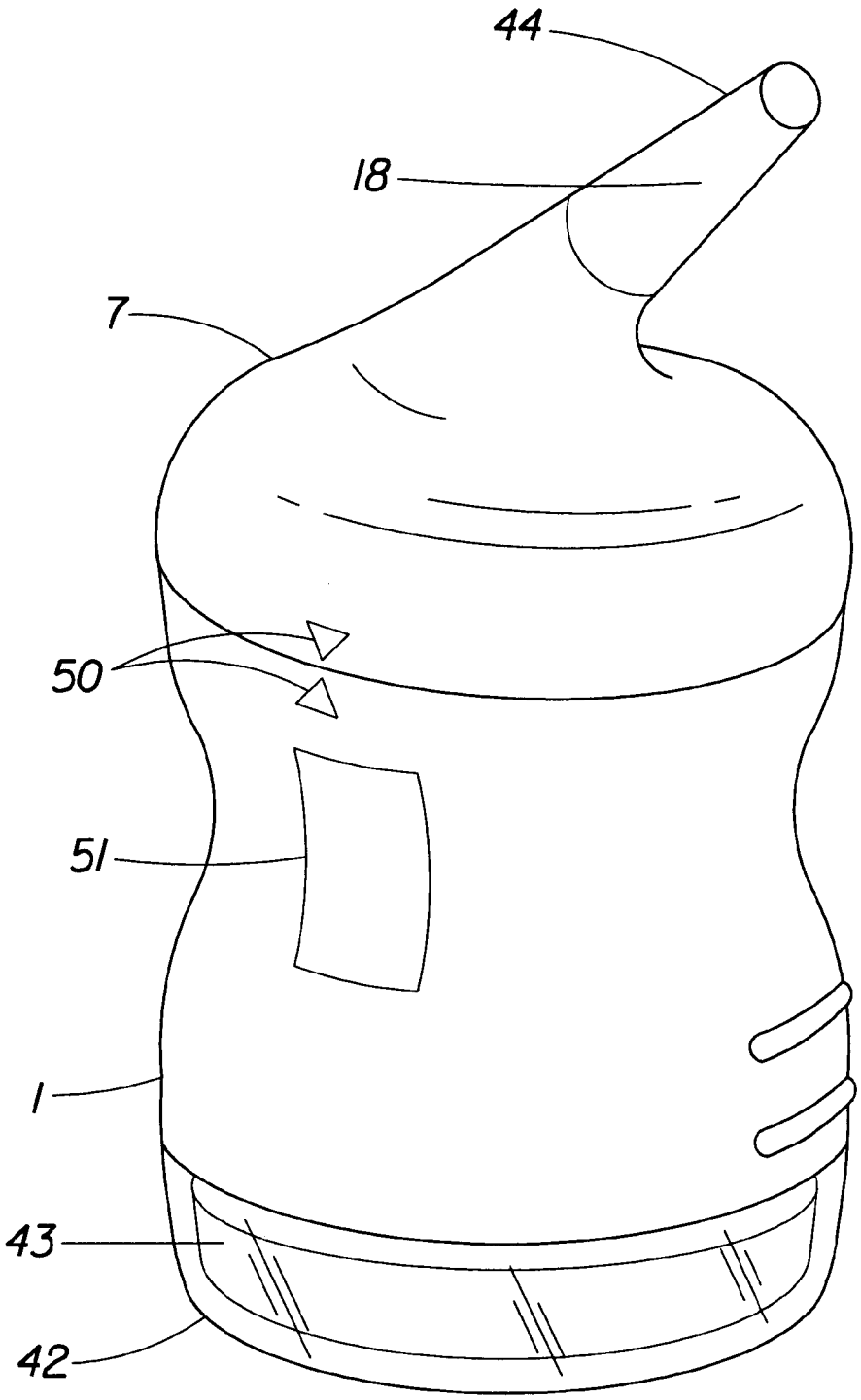
FIG. 18 shows a nozzle-type applicator, a pair of stop marks, and a brush-type applicator opposite the nozzle.

As an optional feature, and as seen in FIG. 18, at 50, a set of stop marks indicate when the seal between the cap member and the housing is substantially water-tight. These stop marks can be any type of mark, such as arrows, color-codes, lines, etc. Another optional feature on the container is a set of usage instructions, also seen in FIG. 18. Both the stop marks and the usage instructions, if present, can be molded during the production process on to any structural component, such as the cap member, the housing, or both. Alternatively, they can be added on by methods known in the art, such as affixing labels, silk-screening, printing directly on the container itself, hot stamping, etc.

As an optional feature, the housing, the cap member, the neck portion, the aperture cover, the covering, or any other container component can contain at least one frictional surface to improve the user's grip on the container, for aesthetic reasons, or for any other reason. See, for example, 8, in FIG. 1. If detergent or fluid spills on the outside of the container, a frictional surface helps the user maintain their grip. The frictional surface, if present, can be any type of friction-enhancing surface known in the art, such as ridges, depressions, rubber grips, separate components, etc., whether formed integrally with the container components, or added separately. A frictional surface is especially preferred on both the housing and the cap member, if present, because these portions of the container may become slippery during use. Furthermore, the frictional surface, or a plurality thereof, assists in easily and conveniently removing and sealing the cap member. In a preferred embodiment, the aperture cover contains a frictional surface to allow easy sealing and unsealing. Similarly, in a preferred embodiment, the covering, if present, contains a frictional surface. In a preferred embodiment, the usage instructions serve the dual purpose of also acting as a frictional surface.

Another preferred optional feature is at least one level indicator, seen in FIG. 1, at 4, which serves to inform the user as to how much detergent, and/or solvent should be added to the container. In a preferred embodiment, the level indicator is molded onto the housing in the production process. In a preferred embodiment, the container has more than one level indicator, preferably more than two level indicators. In a preferred embodiment, the container herein has a set of level indicators for treating normally soiled surfaces and a separate set of level indicators for treating heavily soiled surfaces. In a preferred embodiment, the level indicators serve the dual purpose of also acting as a frictional surface.

Figure 6:
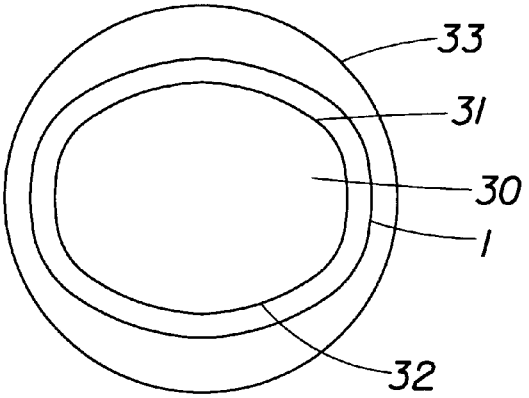
FIG. 6 is a bottom view showing the housing with a rigid edge and a compressible portion.
Figure 7:
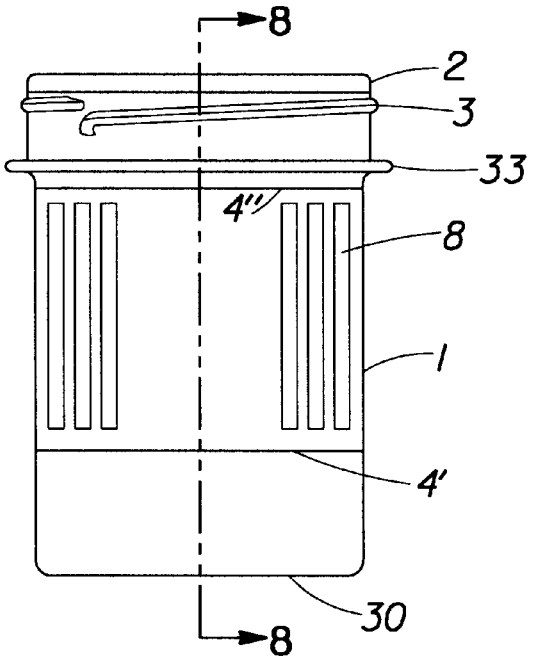
FIG. 7 is a side view of FIG. 6, as seen from point A of FIG. 6.
Figure 8:
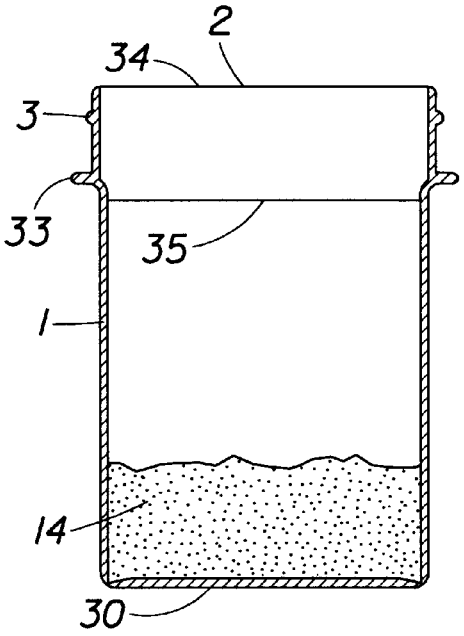
FIG. 8 is a cut-away side-view of FIG. 6 as seen from point B of FIG. 6.

Another optional feature is a lip running along the circumference of the housing, for improving structural rigidity, an example of which is seen as 33, in FIGS. 6–8. This lip is especially useful if the housing is not uniform in cross-section throughout. For example, if the cross section begins at the mouth as a circle, and ends at the far end as an oval, then a lip at the interface where the two shapes meet increases the rigidity of the container, and decreases mouth deformation. If this lip is placed on the outside of the housing, then it can also serve to catch drips as well as to act as a frictional surface.

Another optional feature is a pressure-release mechanism which allows any pressure built-up inside of the housing to slowly equalize with the ambient pressure. This can be achieved through a small release valve, a water-tight, but not-airtight seal, a threaded aperture cover which requires many rotations to release, or any means known in the art.

FIG. 1 shows a housing, 1, which contains a mouth, 2, above an fastener, 3. The depicted fastener, 3, is a screw-type fastener. It is highly preferred that the fastener, 3, form a water-tight seal between the housing, 1, and the cap member, 7 (described below), so as to minimize spilling and leakage. One skilled in the art will recognize that there are many places at which, and many ways in which the fastener can form such a seal. Preferably, the manufacturing tolerances between the housing, 1, and the cap member, 7, are such that when joined by the fastener, 3, they form a substantially water-tight seal therebetween. The housing, 1, also contains two level indicators, 4, and an ergonomic hand-fitting shape as indicated by the indented shape of the sidewall, 5. FIG. 1 also shows a filter, 6 disposed between the cap member, 7, and the housing, 1. The cap member, 7, has a frictional surface, 8, consisting of a set of raised ridges, along the edge.

Inside of an aperture cover, 9, which in this example is transparent, is attached an applicator, 10, depicted here as a brush. The aperture cover, 9, can form a water-tight seal with the cap member, 7, the body member, 1, the applicator, 10, or any other suitable container components. Multiple apertures, 11, can be seen in the applicator, 10.

Figure 2B:
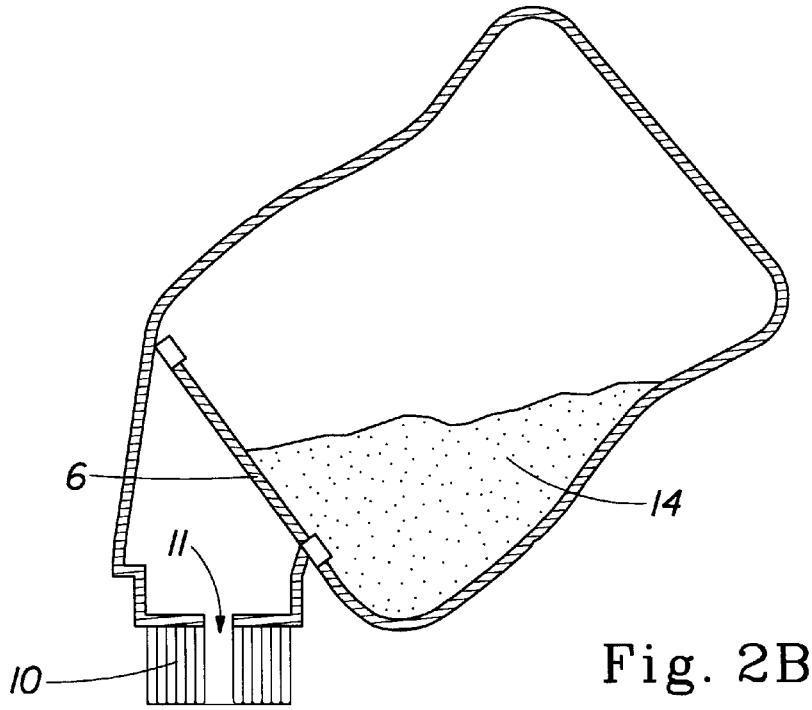
FIG. 2B is a cut-away view of FIG. 2A, in use, showing that the detergent does not completely clog the filter.

FIG. 2A shows further possible details of a cap member, 7, including a neck, 12, extending to the applicator, 10. FIG. 2A also shows an example of a neck angle, 13, herein denoted as $\alpha$. The neck angle, 13, is measured from a line drawn longitudinally through the housing, 1. In FIG. 2A, this appears as a vertical line. Ideally, this neck angle, 13, is such that when the housing, 1, is filled with detergent, 14, up to a level indicator, 4, and the entire container is tilted or otherwise aligned to a dispensing orientation, so as to be used, the detergent does not completely clog the filter. This is illustrated in FIG. 2B, where the container of FIG. 2A is tilted so as to utilize the brush-type applicator, 10. The cut-away drawing of FIG. 2B shows that when the container is aligned into a dispensing orientation as described above, the undissolved detergent, 14, does not completely clog filter, 6, thus allowing dissolved detergent to reach aperture, 11.

Figure 3:
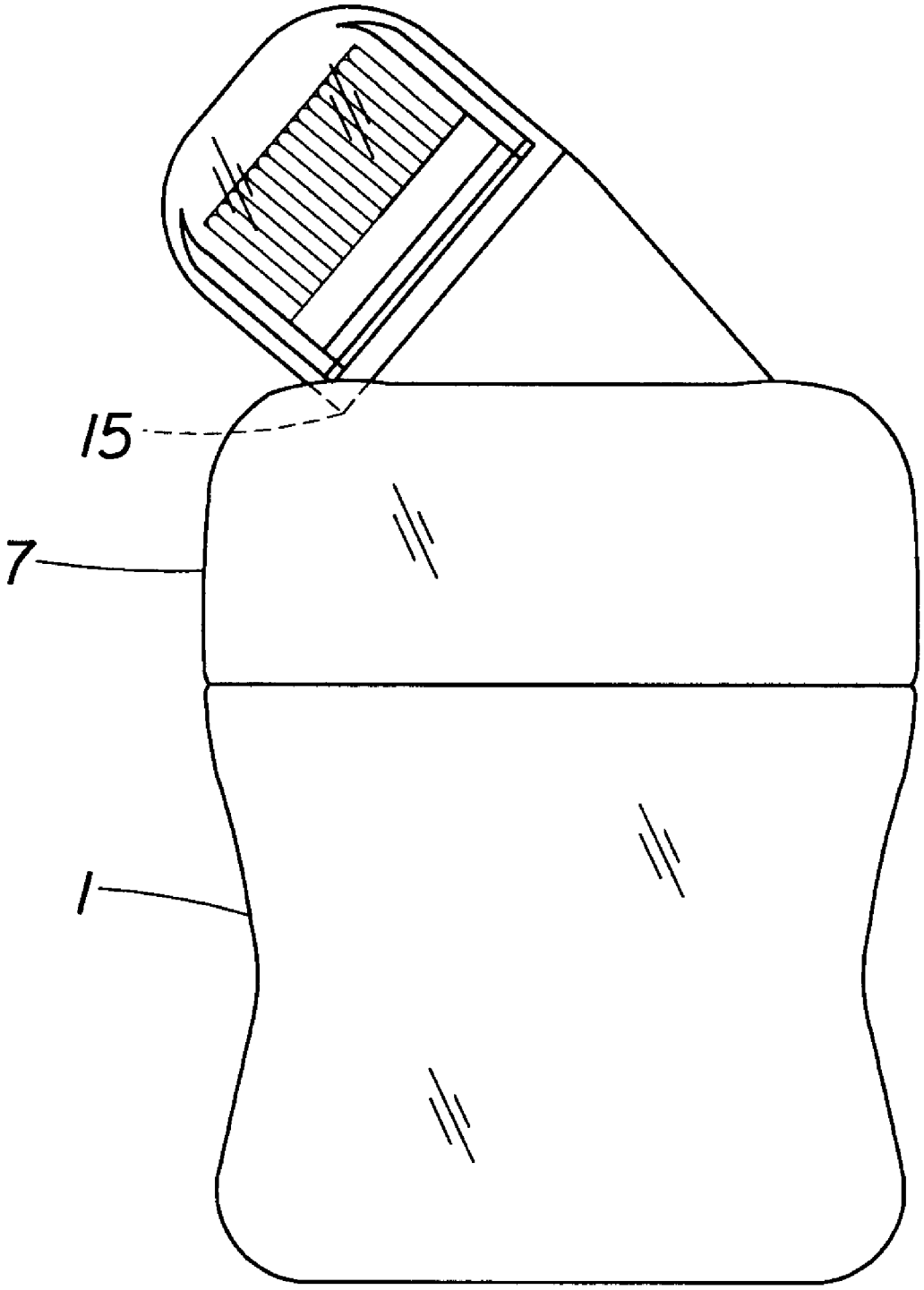
FIG. 3 is a side view showing an inset neck.

FIG. 3 shows a container similar to that of FIG. 2A; however, FIG. 3 has a neck portion, 12, which is slightly inset into the cap member, 7, as indicated by the dotted line 15.

Figure 4:
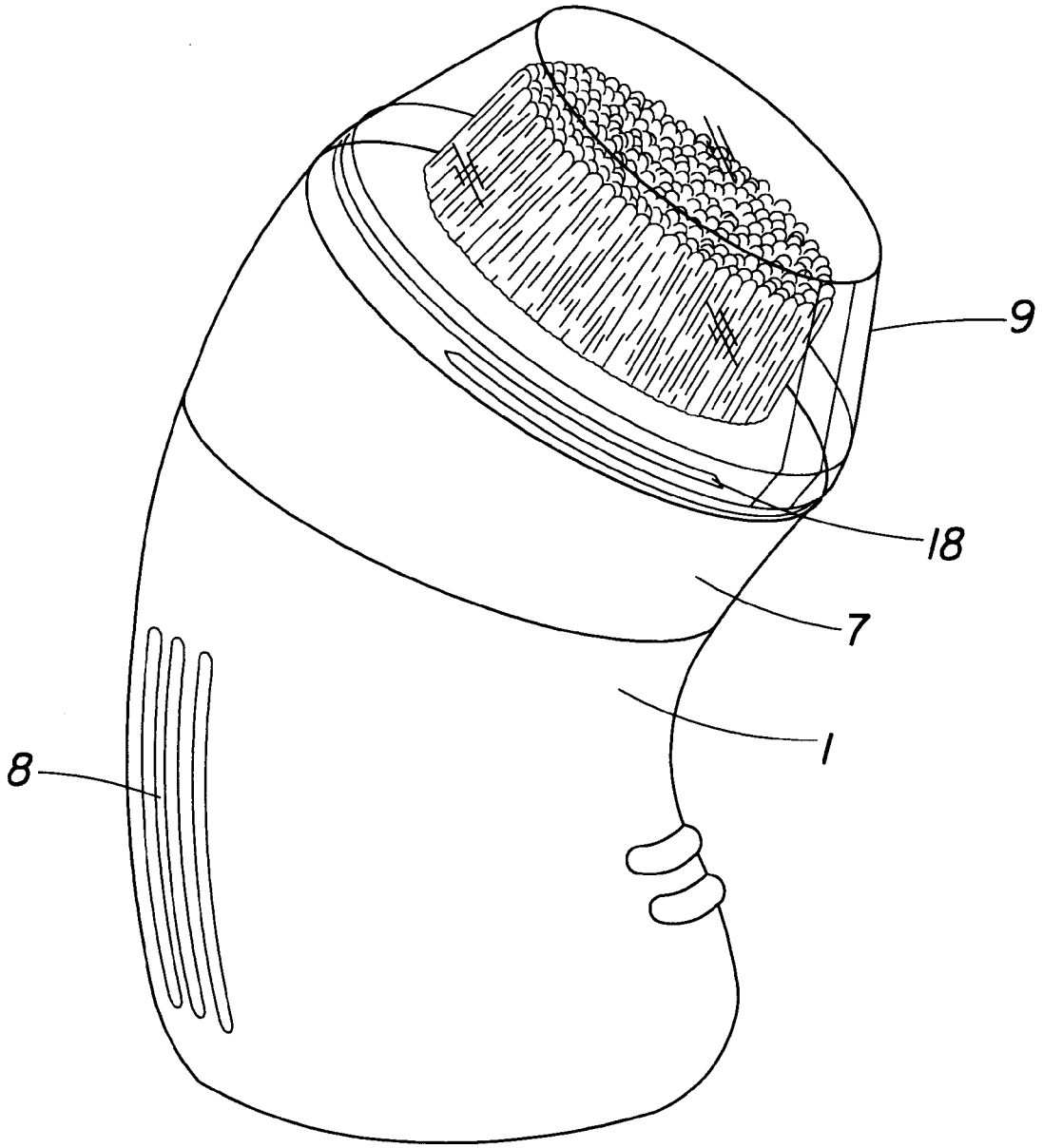
FIG. 4 is a side view showing a curved container shape.

FIG. 4 shows a curved, ergonomic container shape of the current invention with a transparent aperture cover, 9, which is attached to the cap member, 7, via a screw-type closure, forming a water-tight aperture cover, 18. Also indicated is a frictional surface, 8 on the housing, 1.

FIG. 5 shows a detailed cut-away view of a sample cap member, 7, and housing, 1. The fastener, 3, is a screw-type fastener, which can provide a water-tight seal, with the reciprocal closure, 19, of the cap member, 7. FIG. 5 also depicts an inner plug seal, 20, which also can help insure a water-tight seal between the housing, 1, and the cap member, 7. In a preferred embodiment, the fit and manufacturing tolerances between the inner plug seal, 20, and the mouth, 2, are such that they form a water-tight seal. Another possible nonlimiting location to form a water-tight seal between the cap member, 7, and the housing, 1, is denoted at point 21. In FIG. 5, the filter, 6, is held in place at the neck base, 22, via a plurality of filter ridges, 23. A frictional surface, 8, consisting of a series of raised ridges, is shown on the cap member, 7.

FIG. 5 also shows a cut-away view of a water-tight aperture cover, 18. In a preferred embodiment, the water-tight aperture cover, 18, prevents detergent from escaping by forming a water-tight seal. This seal can be with the applicator, 10, the cap member, 7, or any other suitable structure. Possible, nonlimiting locations to form such a seal are detailed in FIG. 5 at points 24 and 25, where the water-tight aperture cover, 18, meets the neck portion, 12, and at point 26, where the water-tight aperture cover, 18, meets the applicator, 10. The neck portion, 12, is a curved neck, having a neck angle, 13, denoted as α. The applicator herein is a brush, having bristles, 27. The dispensing orifice, 28, has a distal end, 29, where the applicator, 10, is attached. A frictional surface, 8, consisting of a series of raised ridges, is shown on the water-tight aperture cover, 18.

FIG. 6 shows a bottom view of a preferred embodiment of the housing, 1, with a bottom, 30, shaped like an oval with flattened ends. The oval with flattened ends is formed by, for example, a rigid edge, 31, and a resilient side wall, 32. Lip, 33, improves the structural rigidity of the housing, 1, and further serves to prevent drips from flowing down the housing, 1.

FIG. 7 is a side view of FIG. 6, as seen from point A of FIG. 6. FIG. 8 is a cut-away side view of FIG. 6, as seen from point B of FIG. 6. Note that in FIG. 7, the bottom, 30, is virtually the same width as the mouth, 2, in contrast to in FIG. 8, where the bottom, 30, is thinner than the mouth, 2. The combination of FIGS. 6–8, shows a preferred embodiment of the housing, 1. FIG. 7 also shows an fastener, 3, which is a screw-type closure which rotates about 180 degrees when attaching to the cap member (not shown). Also indicated in this figure is a first level indicator, 4', and an second level indicator, 4". FIG. 8 also shows an outer container edge, 34, which forms the mouth, 2. This cut-away view shows that the housing, 1, contains an amount of detergent, 14, and an amount of solvent, 35, respectively corresponding to the first level indicator, 4', and the second level indicator, 4", of FIG. 7.

Figure 9:
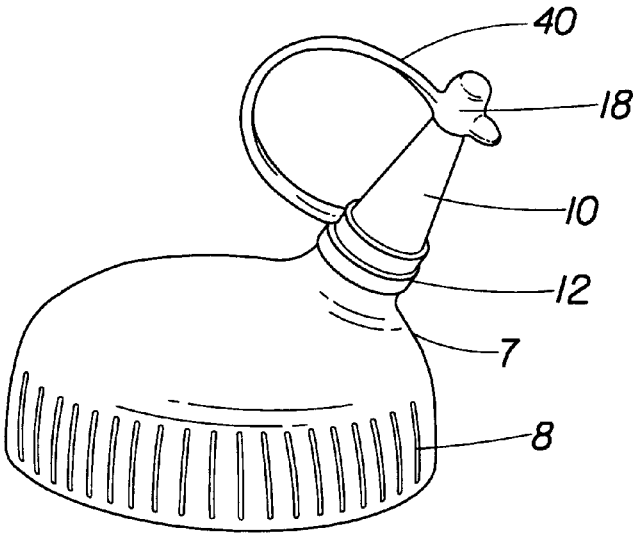
FIG. 9 is a cap member with a matching aperture cover.
Figure 10:
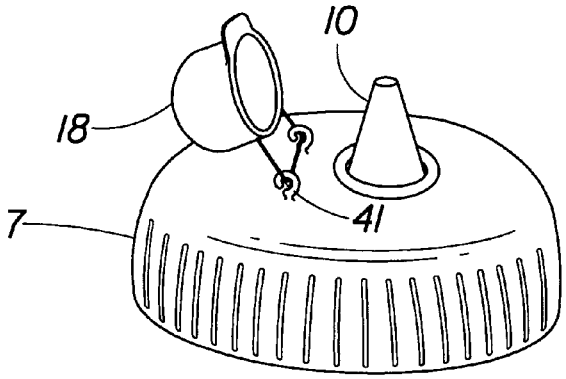
FIG. 10 is another cap member with a matching aperture cover.
Figure 11:
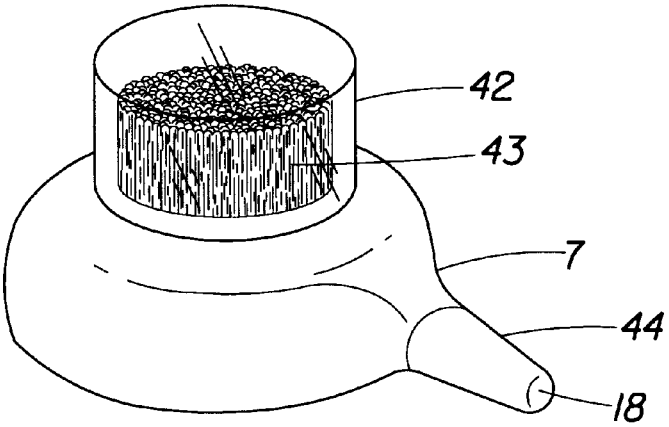
FIG. 11 is an example of a cap member with two separate applicators.

FIG. 9 shows a possible variation of the cap member, 7, and the applicator, 10. The applicator, 10, is a nozzle-type structure, with a water-tight aperture cover, 18, affixed to the neck portion, 12, via a keeper-type fastener, 40, so as to avoid loss of the water-tight aperture cover, 18, during use. FIG. 10 also illustrates a nozzle-type applicator, 10, with a water-tight aperture cover, 18, attached to the cap member, 7, via a hinge-type fastener, 41. FIG. 11 depicts a cap member, 7, and an illustrative configuration of two applicators. A covering, 42, covers a brush-type applicator, 43, while a water-tight aperture cover, 18, seals a nozzle-type applicator, 44. The covering, 42, may or may not be water tight, depending upon whether an aperture, 11, is present under the brush-type applicator, 43.

Figure 12:
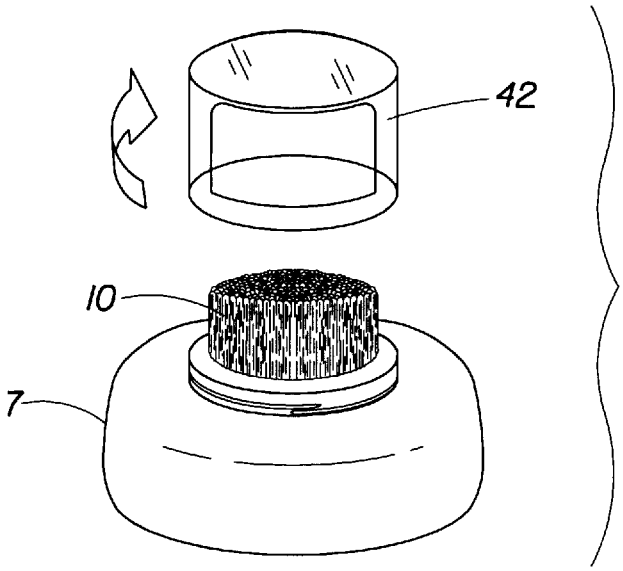
FIG. 12 shows a non-angled brush.

FIG. 12 depicts a cap member, 7, with a centrally positioned, non-angled applicator, 10. The figure also shows a covering, 42, which is removably connected to the cap member, 7. No neck portion is present in this embodiment. The covering, 42, can be connected in any way known in the art, for example, by a screw-type means, as shown here.

Figure 13:
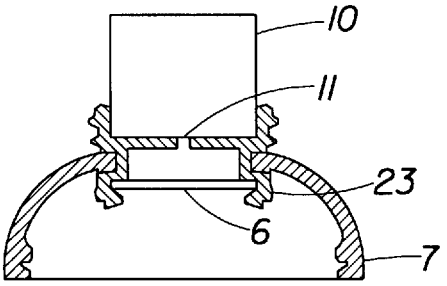
FIG. 13 shows a cross-sectional view of a cap member showing an aperture and a, filter.

FIG. 13 shows a cross-sectional view of a cap member, 7, with a sponge-type applicator, 10. Filter, 6, is aligned perpendicular to a longitudinal line drawn through the housing, which in this case, is a cap member, 7. The filter, 6, is secured in place via a single filter ridge, 23, which runs around the entire circumference of the filter, 6.

Figure 14:
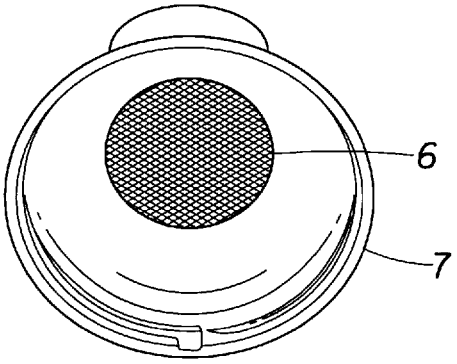
FIG. 14 shows a bottom view of a cap member showing an integral filter.

FIG. 14 illustrates a bottom view of a cap member, 7, with a filter, 6, integral to the cap member, 7.

Figure 15:
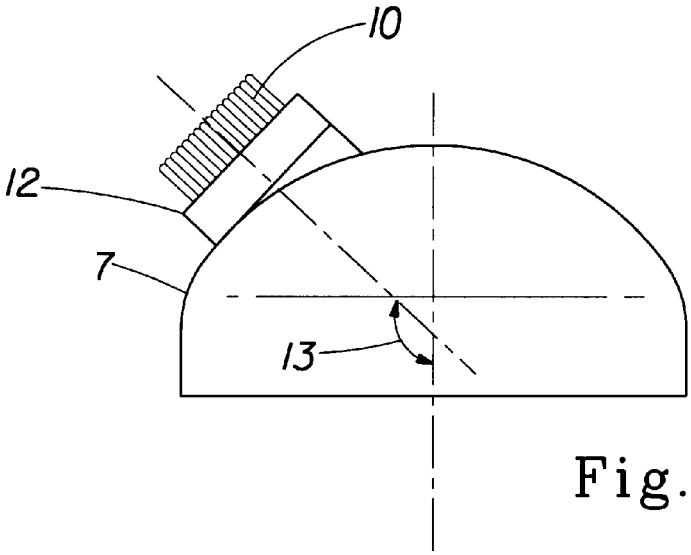
FIG. 15 shows a side view of a cap member with a brush-type applicator and a small neck portion.
Figure 16:
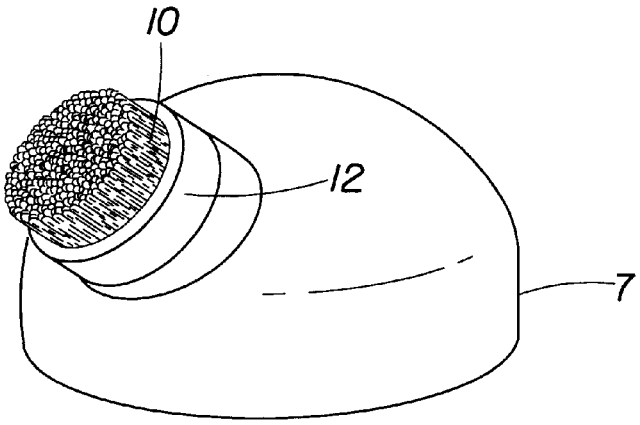
FIG. 16 shows a slightly rotated view of FIG. 15.
Figure 17:
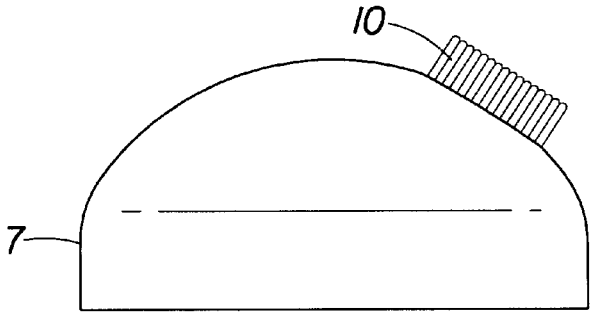
FIG. 17 shows a side view of a cap member with no neck portion and a brush-type applicator.

FIG. 15 illustrates a cap member, 7, with a short neck portion, 12, and a neck angle (α), 13. The neck, 12, of the invention described herein, can be of any reasonable length, and is not limited to short or long necks. This embodiment has an applicator, 10, which consists of a brush. FIG. 16 is a slightly rotated view of FIG. 15, showing the cap member, 7, the short neck portion, 12, and an applicator, 10. FIG. 17 depicts a similar embodiment as FIGS. 15–16, except that there is no neck portion. Furthermore, the bristles of the applicator, 10, in FIG. 17 are longer than in FIGS. 15–16.

FIG. 18 is an illustration of a container with two separate applicators, 10. A nozzle-type applicator, 44, is located on the cap member, 7, and a separate brush-type applicator, 43, is located on the housing, 1. These have a water-tight aperture cover, 18, and a covering, 42, respectively. As in FIG. 11, the covering, 42, may or may not be water tight, depending upon whether an aperture, 11, is present in the brush-type applicator, 43. FIG. 18 also illustrates two paired indicators, 50, and usage instructions, 51, printed on the container itself.

Figure 19A:
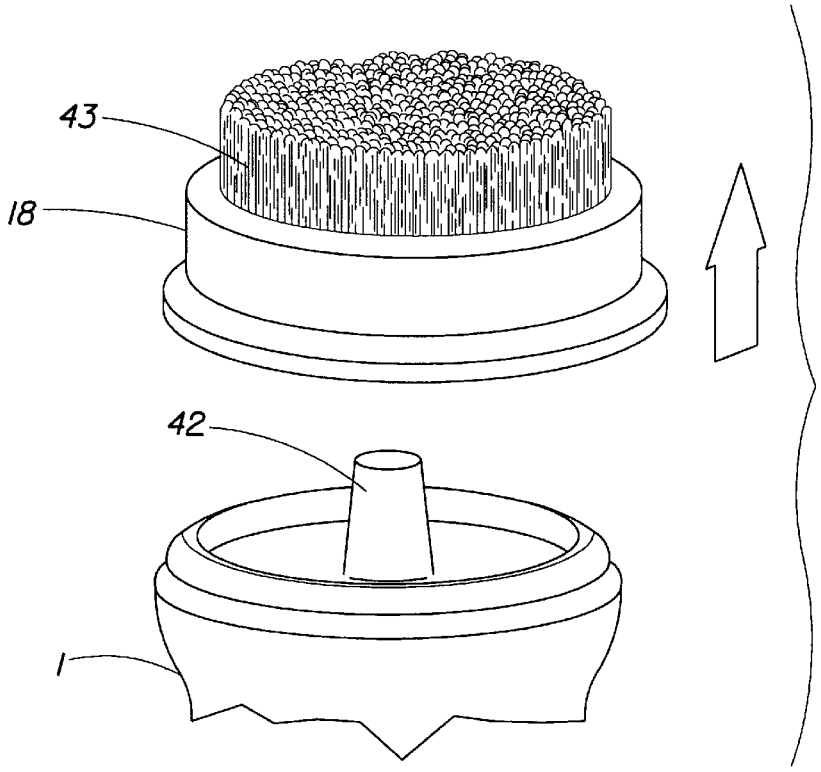
FIG. 19A shows a brush-type applicator integral with a completely removable aperture cover.
Figure 19B:
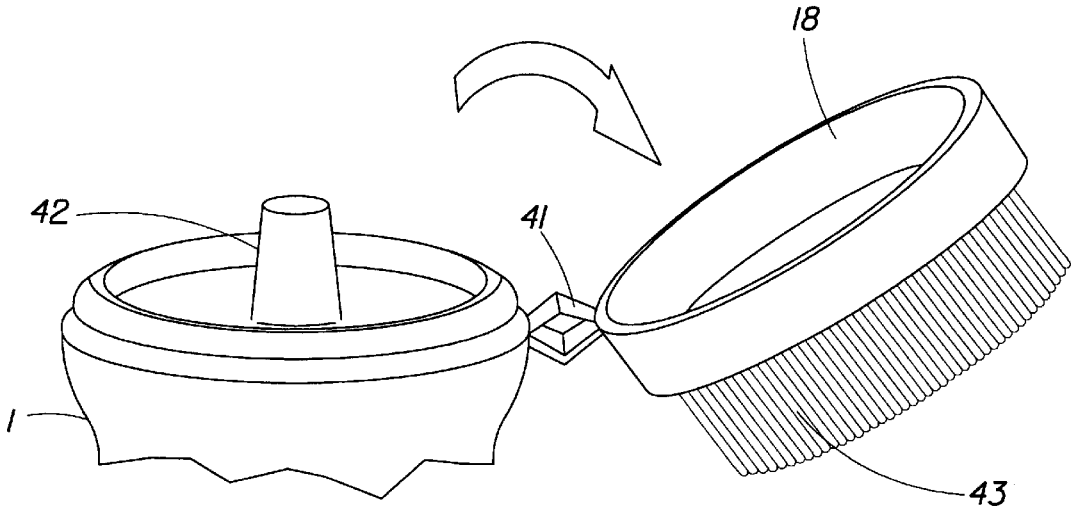
FIG. 19B shows a brush-type applicator integral with an aperture cover attached via a hinge-type fastener.

FIG. 19A shows a brush-type applicator, 43, which is completely removable, from the housing, 1. FIG. 19B shows a brush-type applicator, 43, connected to the housing, 1, via a hinge-type fastener, 41. In both FIG. 19A and FIG. 19B, however, the brush-type applicator, 43, is actually part of the water-tight aperture cover, 18, itself, which provides a water-tight seal with the housing, 1, to prevent leakage. The dissolved detergent composition passes through a nozzle, 42*a*, which is between the water-tight aperture cover,18, and the housing, 1.

Figure 20:
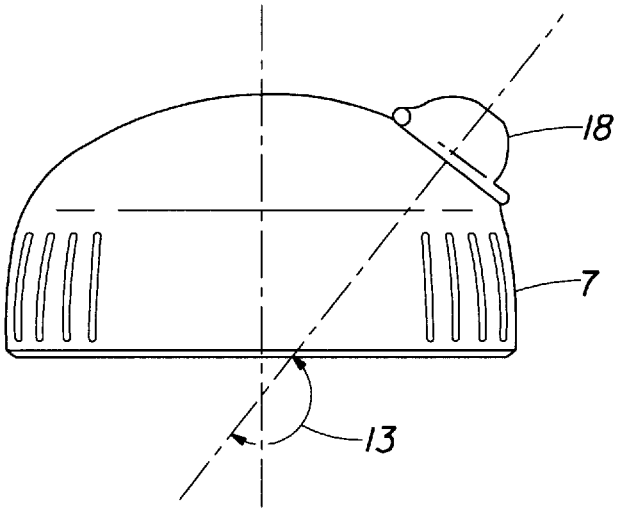
FIG. 20 shows details of a small aperture cover.

FIG. 20 depicts a water-tight aperture cover, 18, attached to the cap member, 7. Inside of the water-tight aperture cover, 18, is an applicator and an aperture (not shown, but exemplified in FIG. 22). The aperture is aligned according to a neck angle, 13, denoted as α.

Figure 21:
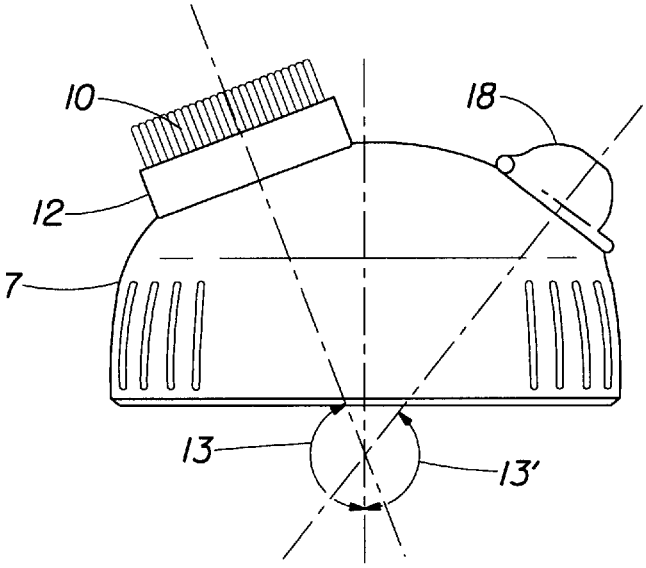
FIG. 21 shows a variation of FIG. 20 with a small aperture cover and a brush-type applicator.
Figure 22:
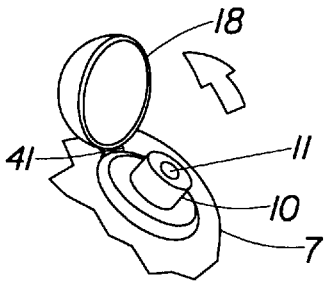
FIG. 22 shows a variation of FIG. 20 with a nozzle-type applicator and a hinged aperture cover.

FIG. 21 illustrates two separate neck angles, 13, denoted as α, and a separate neck angle, 13' denoted as α'. FIG. 22 depicts a possible embodiment of the applicator, 10, and water-tight aperture cover, 18, which was depicted in FIGS. 20–21. Here, the water-tight aperture cover, 18, is attached to the cap member, 7, via a hinge-type fastener, 41. The applicator, 10, is a small nozzle, with an aperture, 11.

Figure 23:
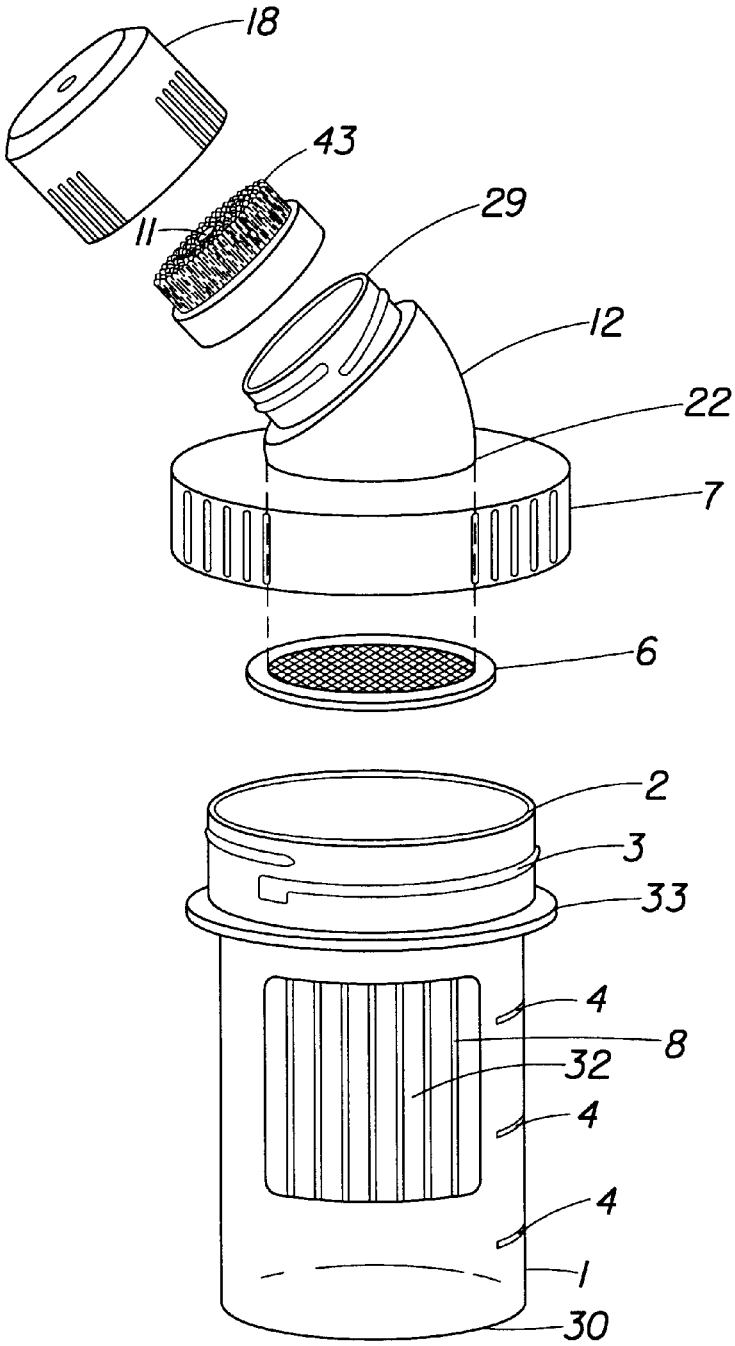
FIG. 23 shows an exploded view of a housing and cap member.

FIG. 23 illustrates an exploded view of an embodiment. The housing, 1, contains a wide mouth, 2. The cross section of housing, 1, changes from a circle, at the mouth, 2, to an oval with flattened ends at the bottom, 30. Lip, 33, provides added structural rigidity and further serves to catch drips. The housing, 1, also has multiple level indicators, 4, a resilient side wall, 32, and a frictional surface, 8.

FIG. 23 also illustrates a filter, 6, which removably attaches to the cap member, 7, via a plurality of filter ridges (not shown), and substantially covers the neck base, 22. The cap member, 7, also has a curved neck portion, 12, topped with a distal end, 29, to which is attached an aperture, 11, surrounded by a brush-type applicator, 43. Removably connected to the neck portion, 12, is a water-tight aperture cover, 18. The cap member, 7, and the housing, 1, form a water-tight seal via a fastener, 3, which is a 180 degree closure, which insures that when the container is assembled for use, the applicator, 10, and the aperture, 11, lie in the plane of symmetry formed by the container.

A preferred embodiment is described in FIG. 23, and has the following additional characteristics: a mouth of about 65 mm, a single aperture with a neck angle of about 135 degrees, and a filter with a mesh size of about 180 microns.

In an embodiment of the invention, the housing and the cap member are permanently fixed together. The housing is made of a flexible film, which has an openable seal distal from the cap member. Solvent and detergent are added from this openable seal.

We claim:

1. A hand-held container for predissolving a detergent composition comprising:

a. a housing for containing a predetermined amount of detergent and solvent;

b. the housing comprising a resilient sidewall;

c. the housing comprising a dispensing passage, the dispensing passage comprising:

i. a flow restriction portion therein; and ii. a distal end; and d. an applicator located at the distal end of the dispensing passage, wherein the dispensing passage is configured so that a fluid having a viscosity of less than about 500 cP and disposed in the container flows out of the dispensing passage at a rate of from about 0 ml/min to about 60 ml/min when the container is placed in a dispensing orientation and no manual pressure is exerted on the resilient sidewall, and wherein the dispensing passage is further configured so that a fluid having a viscosity of less than about 500 cP and disposed therein flows out of the dispensing passage at a rate greater than 300 ml/min when the container is placed in a dispensing orientation and manual pressure is exerted on the sidewall.

2. The container of claim 1 wherein the applicator comprises a brush.

3. The container of claim 2 wherein the brush has a bristle strength of less than about 200N/cm$^2$.

4. The container of claim 1 wherein the dispensing passage further comprises a filter comprising an average pore size of less than about 0.09 mm$^2$, and wherein substantially all dissolved detergent passing through the flow restriction portion first passes through the filter.

5. The container of claim 4 wherein the housing further comprises at least one level indicator, and wherein the filter is a removable filter.

6. The container of claim 4 wherein the flow restriction portion further comprises at least one aperture, and wherein the dispensing passage further comprises a neck portion disposed between the aperture and the filter, the neck portion comprising at least one neck angle of from about 120 degrees to about 150 degrees as measured from a longitudinal line drawn through the housing.

7. The container of claim 4, wherein the filter has an average pore size of from about 0.625 mm$^2$ to about 0.0002 mm$^2$.

8. The container of claim 4, wherein the filter has an average pore size of from about 0.05 mm$^2$ to about 0.0012 mm$^2$.

9. The container of claim 1 wherein the flow restriction portion further comprises at least one aperture.

10. The container of claim 9 wherein the aperture has an area of from about 0.0019 mm$^2$ to about 16 mm$^2$.

11. The container of claim 1 wherein when the dispensing passage has one applicator.

12. A hand-held container for predissolving a detergent composition comprising:

a. a housing for containing a predetermined amount of detergent and solvent;

b. the housing comprising a resilient sidewall;

c. the housing comprising a dispensing passage, the dispensing passage comprising:

i. a flow restriction portion therein comprising an aperture with an area of from about 0.0019 mm$^2$ to about 16 mm$^2$;

ii. a distal end; and iii. a filter comprising a mesh or screen and having an average pore size of less than about 0.09 mm$^2$; and d. a brush located at the distal end of the dispensing passage in connected relation to the aperture, wherein substantially all dissolved detergent passing through the flow restriction portion first passes through the filter, and wherein the dispensing passage is configured so that a fluid having a viscosity of less than about 500 cP and disposed in the container flows out of the aperture at a rate of from about 0 ml/min to about 300 ml/min when the container is placed in a dispensing orientation and no manual pressure is exerted on the resilient sidewall.

13. The container of claim 12, wherein the filter has an average pore size of from about 0.625 mm$^2$ to about 0.0002 mm$^2$.

14. The container of claim 12, wherein the filter has an average pore size of from about 0.05 mm$^2$ to about 0.0012 mm$^2$.

15. A hand-held container for predissolving a detergent composition comprising:

a. a housing for containing a predetermined amount of detergent and solvent;

b. the housing comprising a resilient sidewall;

c. the housing comprising a dispensing passage, the dispensing passage comprising:

i. a flow restriction portion therein;

ii. a distal end; and iii. a filter comprising a mesh or screen having an average pore size of less than about 0.09 mm$^2$;

d. an applicator located at the end of the dispensing passage, wherein the dispensing passage is configured so that a fluid having a viscosity of less than about 500 cP and disposed in the container flows out of the dispensing passage at a rate of from about 0 ml/min to about 300 ml/min when the container is placed in a dispensing orientation and no manual pressure is exerted on the resilient sidewall.

16. The container of claim 15, wherein the applicator comprises a brush.

17. The container of claim 16, wherein the brush has a bristle strength of less than about 200N/cm$^2$.

18. The container of claim 15, wherein the housing further comprises at least one level indicator, and wherein the filter is a removable filter.

19. The container of claim 15, wherein the flow restriction portion further comprises at least one aperture, and wherein the dispensing passage further comprises a neck portion disposed between the aperture and the filter, the neck portion comprising at least one neck angle of from about 120 degrees to about 150 degrees as measured from a longitudinal line drawn through the housing.

* * * * *